US008678788B2

(12) United States Patent
Kim et al.

(10) Patent No.: US 8,678,788 B2
(45) Date of Patent: Mar. 25, 2014

(54) LINEAR COMPRESSOR

(75) Inventors: Jung-Hae Kim, Incheon (KR); Yoon-Seok Yang, Incheon (KR); Jaesang Park, Changwon-shi (KR); Seong-Joon Hong, Sungnam-si (KR); Dong-Han Kim, Seoul (KR); Seong-Yeol Hyeon, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 750 days.

(21) Appl. No.: 12/739,172

(22) PCT Filed: Oct. 10, 2008

(86) PCT No.: PCT/KR2008/005995

§ 371 (c)(1),
(2), (4) Date: Apr. 22, 2010

(87) PCT Pub. No.: WO2009/054635

PCT Pub. Date: Apr. 30, 2009

(65) Prior Publication Data

US 2010/0242721 A1 Sep. 30, 2010

(30) Foreign Application Priority Data

Oct. 24, 2007 (KR) ..... 10-2007-0107383

(51) Int. Cl.
*F04B 17/04* (2006.01)

(52) U.S. Cl.
USPC ..... 417/417; 417/416; 417/415

(58) Field of Classification Search
None
See application file for complete search history.

(56) References Cited

U.S. PATENT DOCUMENTS

| | | | | |
|---|---|---|---|---|
| 3,887,304 | A | 6/1975 | Otaki et al. | |
| 2005/0142007 | A1 | 6/2005 | Lee et al. | |
| 2006/0057000 | A1 * | 3/2006 | Hyeon | 417/415 |
| 2006/0127250 | A1 * | 6/2006 | Park et al. | 417/417 |

FOREIGN PATENT DOCUMENTS

| | | |
|---|---|---|
| EP | 0 521 526 | 1/1993 |
| EP | 0 745 773 | 12/1996 |
| EP | 1 686 264 | 8/2006 |
| WO | WO 02/084121 | 10/2002 |
| WO | WO 02/095232 | 11/2002 |
| WO | WO 2004/081379 | 9/2004 |

OTHER PUBLICATIONS

European Search Report dated Oct. 17, 2011.
International Search Report issued in PCT/KR200/005995 dated Mar. 3, 2010.

* cited by examiner

*Primary Examiner* — Christopher Bobish
(74) *Attorney, Agent, or Firm* — Ked & Associates LLP

(57) ABSTRACT

A linear compressor is provided. Unnecessary parts of a motor cover of the compressor are bent toward a rear cover in an axis direction to form supporting ends of the motor cover, and the supporting ends of the motor cover are welded directly to the rear cover, thereby considerably cutting down the material cost.

3 Claims, 7 Drawing Sheets

LINEAR COMPRESSOR

TECHNICAL FIELD

The present invention relates to a linear compressor, and more particularly, to a linear compressor which can improve productivity by fixedly welding a motor cover to a rear cover.

BACKGROUND ART

Generally, in a reciprocating compressor, a compression space to/from which an operation gas is sucked and discharged is defined between a piston and cylinder, so that the piston is linearly reciprocated inside the cylinder to compress refrigerant.

Since the reciprocating compressor includes a component for converting a rotation force of a driving motor into a linear reciprocation force of the piston, such as a crank shaft, a large mechanical loss occurs due to the motion conversion. Recently, a linear compressor has been actively developed to solve the foregoing problem.

In the linear compressor, particularly, a piston is connected directly to a linearly-reciprocated linear motor to prevent the mechanical loss by the motion conversion, improve the compression efficiency and simplify the configuration. Power inputted to the linear motor can be regulated to control the operation thereof. Accordingly, since the linear compressor can reduce noise more than the other compressors, it has been mostly applied to electric home appliances used indoors, such as a refrigerator.

FIG. 1 is a view illustrating an example of a conventional linear compressor.

In the conventional linear compressor, a structure composed of a frame 1, a cylinder 2, a piston 3, a suction valve 4, a discharge valve assembly 5, a linear motor 6, a motor cover 7, a supporter 8, a rear cover 9, main springs S1 and S2 and a muffler assembly 10 is installed to be elastically supported inside a shell (not shown).

The cylinder 2 is fixedly fitted into the frame 1, the discharge valve assembly 5 composed of a discharge valve 5*a*, a discharge cap 5*b* and a discharge valve spring 5*c* is installed to block one end of the cylinder 2, the piston 3 is inserted into the cylinder 2, and the thin suction valve 4 is installed to open and close an outlet 3*a* of the piston 2.

In the linear motor 6, a permanent magnet 6*c* is installed to be linearly reciprocated, maintaining an air-gap between an inner stator 6*a* and an outer stator 6*b*. The permanent magnet 6*c* is connected to the piston 3 by a connection member 6*d*, and linearly reciprocated due to a mutual electromagnetic force between the inner stator 6*a*, the outer stator 6*b* and the permanent magnet 6*c* to thereby operate the piston 3.

The motor cover 7 supports the outer stator 6*b* in an axis direction to fix the outer stator 6*b*, and is bolt-fixed to the frame 1. The rear cover 9 is coupled to the motor cover 7. The supporter 8 connected to the other end of the piston 3 is installed between the motor cover 7 and the rear cover 9 to be elastically supported by the main springs S1 and S2 in an axis direction. The muffler assembly 10 for sucking refrigerant is fastened together with the supporter 8. The reference number 20 indicates a mass member installed on the supporter 8.

Here, the main springs S1 and S2 include four front springs S1 and four rear springs S2 in up-down and left-right positions symmetric around the supporter 8. When the linear motor 6 is operated, the front springs S1 and the rear springs S2 are driven in the opposite directions to buff the piston 3 and the supporter 8. Besides, refrigerant in a compression space P serves as a kind of gas spring to buff the piston 3 and the supporter 8.

Therefore, when the linear motor 6 is operated, the piston 3 and the muffler assembly 10 connected thereto are linearly reciprocated. Since a pressure inside the compression space P is varied, the operations of the suction valve 4 and the discharge valve assembly 5 are automatically controlled. During the operation, refrigerant flows through a suction tube on the shell side, an opening portion of the rear cover 9, the muffler assembly 10 and an inlet 3*a* of the piston 3, is sucked into and compressed in the compression space P, and is externally discharged through the discharge cap 5*b*, a loop pipe and a discharge tube on the shell side.

FIG. 2 is a view illustrating an example of an installation structure of the motor cover and the rear cover of the conventional linear compressor. The conventional motor cover 7 is formed in the shape of a disk with a central opening portion so that the piston 3 (refer to FIG. 1) can pass through the opening portion. A pair of spring supporting portions protruding to support the front main springs S1 (refer to FIG. 1) with the supporter 8 (refer to FIG. 1) are provided at both sides of the opening portion, respectively. A protruding end 8 protruding in an axis direction opposite to the compression space P (refer to FIG. 1) is provided at a rim portion of the motor cover 7. A plurality of bolt holes 9*c* are formed in portions coupled to the rear cover 9 inside the protruding end.

The conventional rear cover 9 is formed in the shape of a plate with a central opening portion so that a part of the muffler assembly 10 (refer to FIG. 1) can be mounted on the opening portion. A pair of spring supporting portions 9*a* protruding to support the rear main spring S2 (refer to FIG. 1) are provided at both sides of the opening portion, respectively. A pair of supporting ends 9*b* bent toward the compression space P (refer to FIG. 1) and then outwardly bent to be brought into contact with the motor cover 7 are provided at both ends of the rear cover 9. A plurality of bolt holes 9*c* are formed in portions of the supporting ends 9*b* coupled to the motor cover 7.

When the motor cover 7 and the supporting ends 9*b* of the rear cover 9 are brought into contact, bolts B are fastened to the bolt holes 9*c* of the motor cover 7 and the bolt holes 9*c* of the rear cover 9. Here, a plurality of spacers 7*d* can be installed in the contact portions of the motor cover 7 and the supporting ends 9*b* of the rear cover 9 to maintain a predetermined interval in an axis direction. A dimension design value is different in each product model, and a dimension tolerance is generated during an assembly process. In this circumstance, so as to compensate for a dimension variation value, the spacers 7*d* are used to regulate a distance from the motor cover 7 to the rear cover 9.

However, in the conventional reciprocating compressor, in order to adjust an initial design value, an assembly tolerance and a measurement tolerance, the spacers are inserted between the motor cover and the rear cover of fixed standard, and the motor cover, the spacers and the rear cover are bolt-assembled at a time. As a result, the assembly time increases and the production cost rises because of the spacers.

DISCLOSURE OF INVENTION

Technical Problem

The present invention has been made to solve the above-described shortcomings occurring in the prior art, and an object of the present invention is to provide a linear compressor which can omit spacers by connecting a motor cover directly to a rear cover.

Another object of the present invention is to provide a linear compressor which can save materials by connecting an unnecessary part of a motor cover to a rear cover.

Technical Solution

According to the present invention for achieving the aforementioned objects, there is provided a linear compressor, including: a cylinder having a compression space of refrigerant therein; a piston linearly reciprocated inside the cylinder to compress the refrigerant; a supporter connected to the back of the piston; a plurality of front and rear main springs for elastically supporting the supporter; a motor cover installed at the front of the supporter with a predetermined interval in an axis direction to support the front main springs, a pair of supporting ends being formed by partially cutting an inner portion of the motor cover and bent backward; and a rear cover installed at the back of the supporter with a predetermined interval in an axis direction to support the rear main springs, and fixedly welded to the supporting ends of the motor cover.

In addition, the supporting ends of the motor cover and the rear cover are surface-welded to each other.

Moreover, the rear cover includes a pair of welding portions formed by partially bending both ends thereof, and the welding portions of the rear cover are welded in contact with opposite surfaces of the supporting ends of the motor cover, respectively.

Further, an initial position of the piston is set up according to axis direction welding positions of the supporting ends of the motor cover and the rear cover.

Advantageous Effects

As discussed earlier, in the linear compressor according to the present invention, the motor cover and the rear cover are welded directly to each other. During the welding process, the welding positions of the motor cover and the rear cover are adjusted in an axis direction, thereby dealing with various dispersions and lowering a defect rate. In addition, components required for the bolt assembly, such as spacers, bolts, etc., can be omitted to reduce the assembly process time and cut down the production cost.

Moreover, in the linear compressor according to the present invention, the un-necessary parts of the motor cover are bent toward the rear cover in an axis direction to form the supporting ends of the motor cover, and the supporting ends of the motor cover are welded directly to the rear cover, thereby considerably cutting down the material cost.

MODE FOR THE INVENTION

Hereinafter, preferred embodiments of the present invention will be described in detail with reference to the accompanying drawings.

Figure 1:
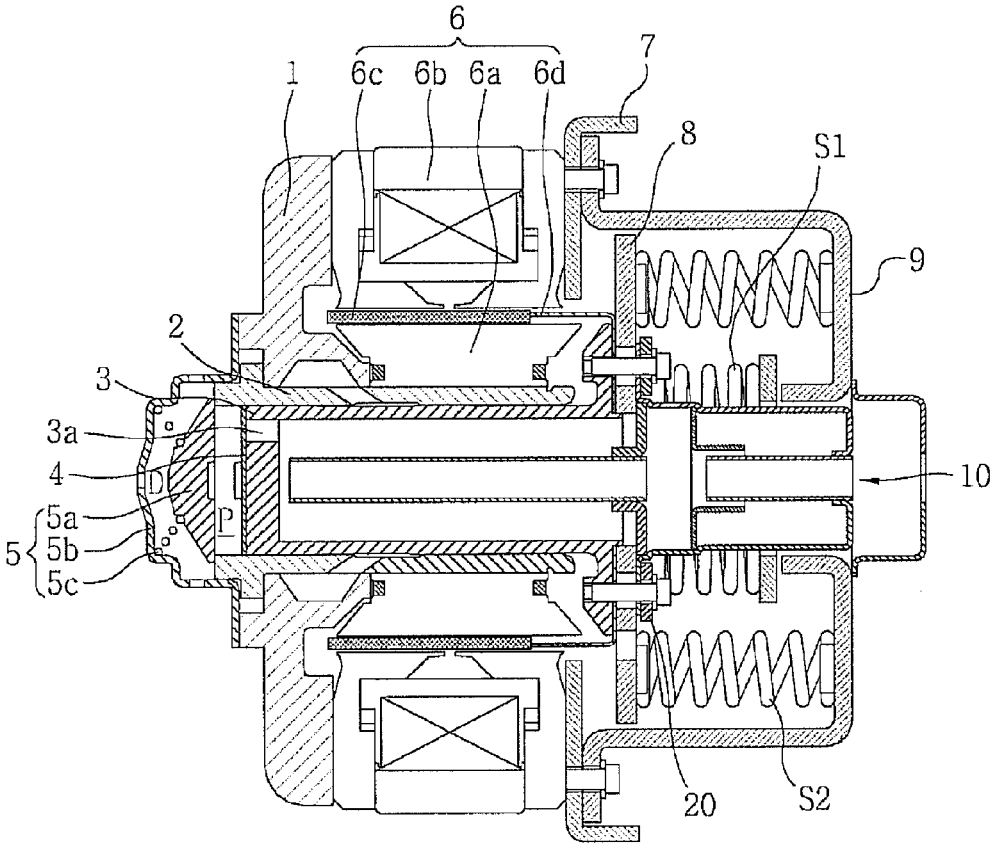
Fig 1 CONVENTIONAL ART
FIG. 1 is a view illustrating an example of a conventional linear compressor.
Figure 2:
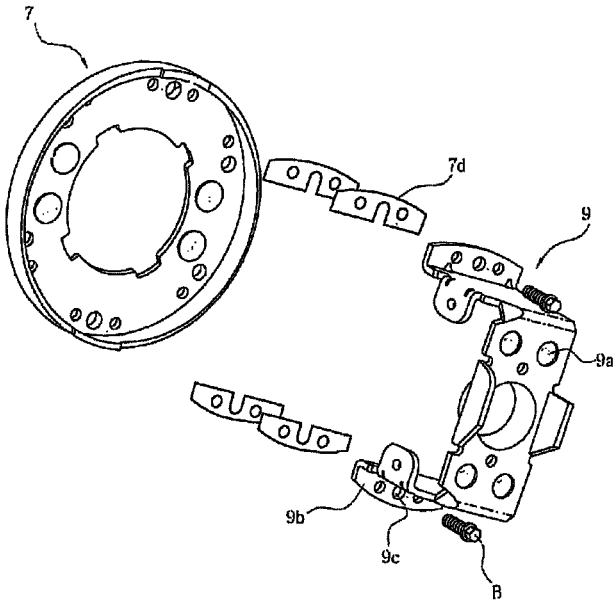
Fig 2 CONVENTIONAL ART
FIG. 2 is a view illustrating an example of an installation structure of the motor cover and the rear cover of the conventional linear compressor.
Figure 3:
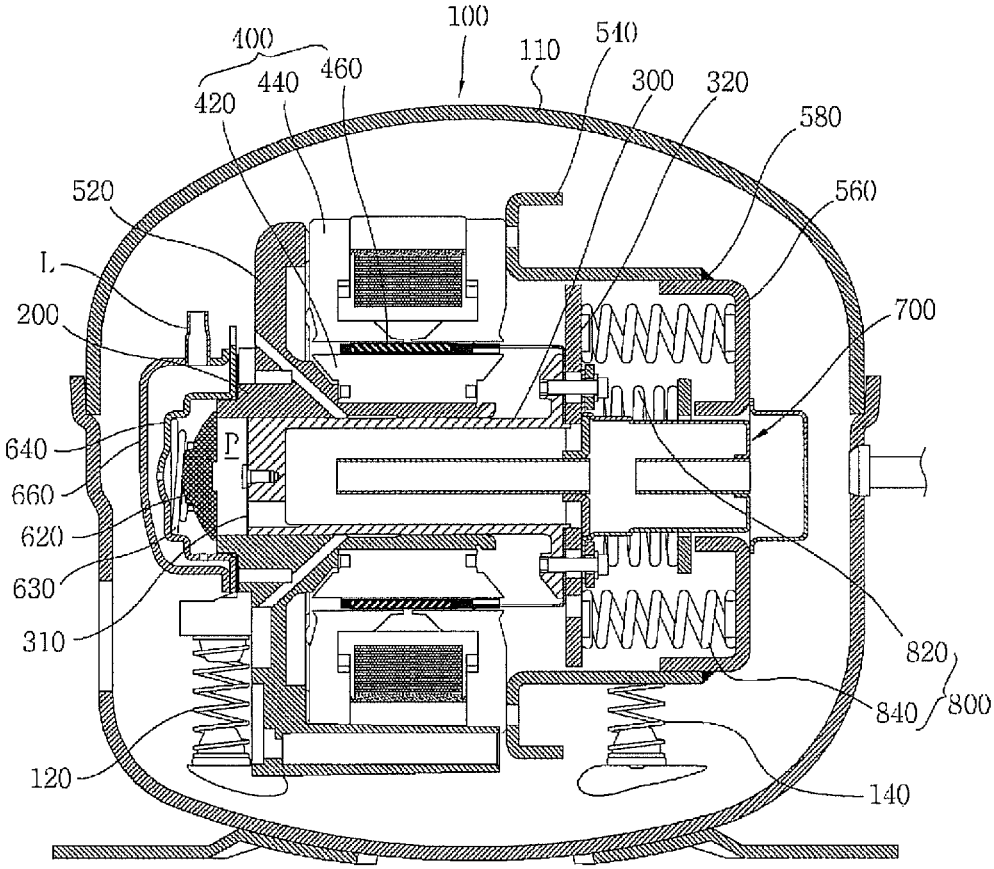
FIG. 3 is a view illustrating a linear compressor according to an embodiment of the present invention.

FIG. 3 is a view illustrating a linear compressor according to an embodiment of the present invention. The linear compressor 100 according to the present invention includes a cylinder 200, a piston 300, and a linear motor 400 composed of an inner stator 420, an outer stator 440 and a permanent magnet 460 inside a shell 110 which is a hermetic container. When the permanent magnet 460 is linearly reciprocated between the inner stator 420 and the outer stator 440 due to a mutual electromagnetic force, the piston 300 connected to the permanent magnet 460 is linearly reciprocated together with the permanent magnet 460.

The inner stator 420 is fixed to an outer circumference of the cylinder 200, and the outer stator 440 is fixed by a frame 520 and a motor cover 540 in an axis direction. The frame 520 and the motor cover 540 are fastened to each other by means of a fastening member such as a bolt, so that the outer stator 440 is fixed between the frame 520 and the motor cover 540. The frame 520 can be integrally formed with the cylinder 200, or individually formed from the cylinder 200 and coupled to the cylinder 200. In the embodiment of FIG. 3, the frame 520 and the cylinder 200 are integrally formed.

A supporter 320 is connected to the back of the piston 300. Both ends of two front main springs (not shown) are supported by the supporter 320 and the motor cover 540. In addition, both ends of rear main springs 820, 840 are supported by the supporter 320 and a rear cover 560. The rear cover 560 is coupled to the back of the motor cover 540. Moreover, a suction muffler 700 is provided at the back of the piston 300. Refrigerant is introduced into the piston 300 through the suction muffler 700, thereby considerably suppressing refrigerant suction noise. At this time, the suction muffler 700 is positioned inside the rear main springs 820, 840.

The piston 300 is hollowed so that the refrigerant introduced through the suction muffler 700 can be sucked into and compressed in a compression space P defined between the cylinder 200 and the piston 300. A valve 310 is installed at a front end of the piston 300. The valve 310 opens the front end of the piston 300 so as to allow the refrigerant to flow from the piston 300 to the compression space P, and blocks the front end of the piston 300 so as to prevent the refrigerant from returning from the compression space P to the piston 300.

When the refrigerant is compressed over a predetermined pressure in the compression space P by the piston 300, a discharge valve 620 positioned at a front end of the cylinder 200 is opened. The discharge valve 620 is installed inside a supporting cap 640 fixed to one end of the cylinder 200 to be elastically supported by a spiral discharge valve spring 630. The high pressure compressed refrigerant is transferred into a discharge cap 660 through a hole formed in the supporting cap 640, discharged to the outside of the linear compressor 100 through a loop pipe L, and circulated in a freezing cycle.

The respective components of the linear compressor 100 are supported by a front supporting spring 120 and a rear supporting spring 140 in an assembled state, and spaced apart from the bottom of the shell 110. Since the components are not in contact with the bottom of the shell 110, vibration generated in each component of the linear compressor 100 compressing the refrigerant is not transferred directly to the shell 110. Therefore, vibration transferred to the outside of the shell 110 and noise generated by vibration of the shell 110 can be remarkably reduced.

Figure 4:
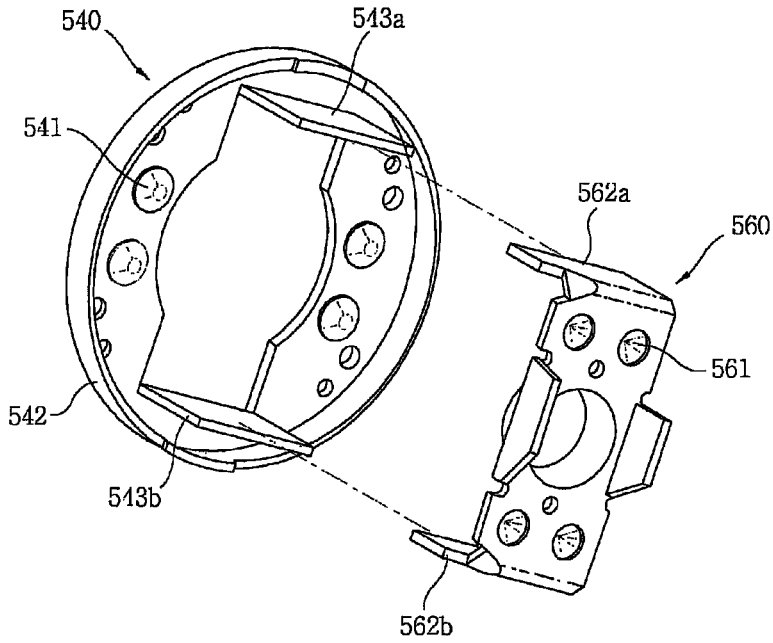
FIG. 4 is a view illustrating an example of an installation structure of the motor cover and the rear cover of the linear compressor according to the present invention.

FIG. 4 is a view illustrating an example of an installation structure of the motor cover and the rear cover of the linear compressor according to the present invention. The motor cover 540 is formed in a circular disk shape. A pair of spring supporting portions 541 are provided at both sides of the motor cover 540 to support the front main springs (not shown), respectively. A protruding end 542 protruding in an opposite direction to the compression space P (refer to FIG. 3) is provided at a rim portion of the motor cover 540. An opening portion is formed in a center of the motor cover 540 so that the piston 300 (refer to FIG. 3) can be linearly reciprocated through the opening portion. A pair of supporting ends 543*a* and 543*b* are provided, protruding in an opposite direction to the compression space P (refer to FIG. 3). The supporting ends 543*a* and 543*b* of the motor cover 540 are positioned between the spring supporting portions 541, maintaining a predetermined area in a width direction.

The rear cover 560 is formed in the shape of a rectangular plate. A pair of spring supporting portions 561 are provided in a direction where the supporting ends 543*a* and 543*b* of the motor cover 540 are positioned so as to support the rear main springs 820, 840 (refer to FIG. 3). Ends adjacent to the spring supporting portions 561 are bent toward the compression space P (refer to FIG. 3) to form a pair of welding portions 562*a* and 562*b*. The welding portions 562*a* and 562*b* of the rear cover 560 maintain a predetermined area in a width direction to be brought into contact with the supporting ends 543*a* and 543*b* of the motor cover 540 and surface-welded thereto. An interval between the welding portions 562*a* and 562*b* of the rear cover 560 is narrower than an interval between the supporting ends 543*a* and 543*b* of the motor cover 540 so that outer surfaces of the welding portions 562*a* and 562*b* of the rear cover 560 can be welded in contact with inner surfaces of the supporting ends 543*a* and 543*b* of the motor cover 540.

Figure 5:
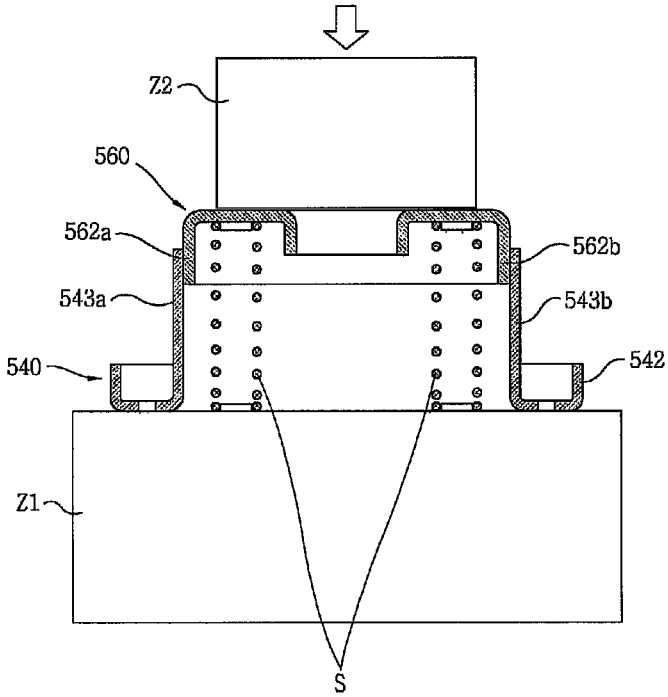
FIGS. 5 to 7 are views illustrating an example of an installation process of the motor cover and the rear cover of the linear compressor according to the present invention.
Figure 6:
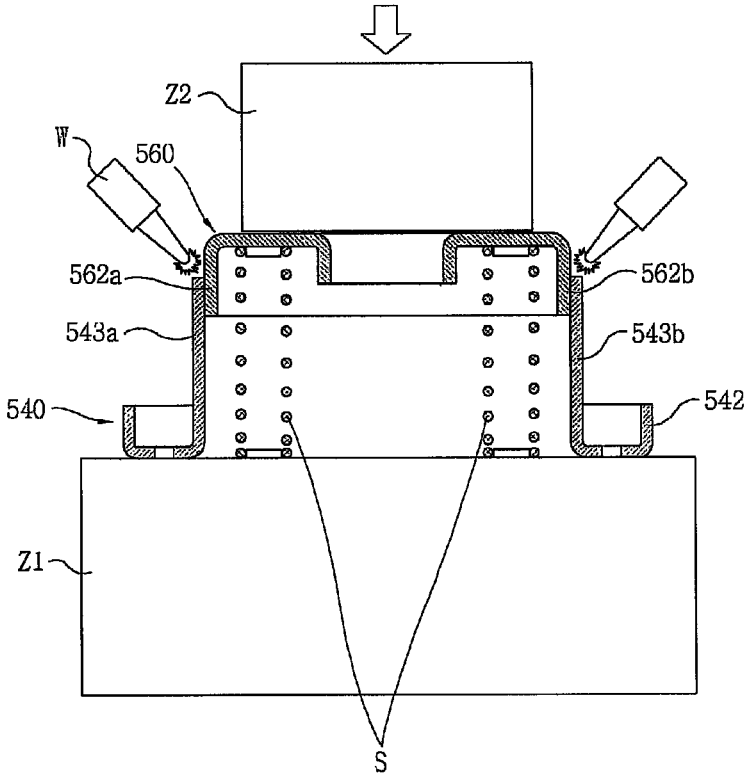
Figure 7:
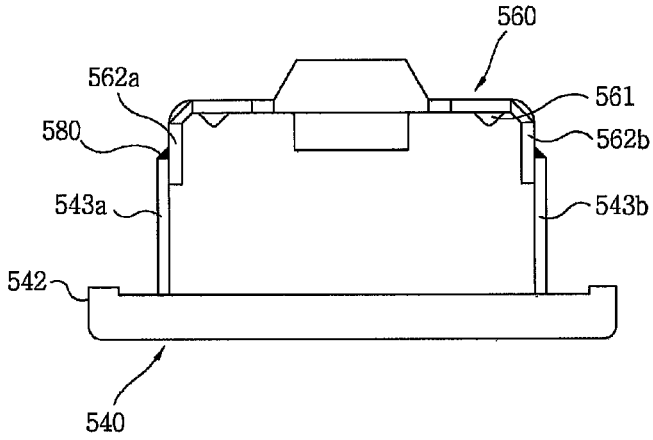

FIGS. 5 to 7 are views illustrating an example of an installation process of the motor cover and the rear cover of the linear compressor according to the present invention.

As illustrated in FIG. 5, the motor cover 540 is put on a lower jig Z1, assembly springs S are put on the lower jig Z1 to be positioned inside the supporting ends 543*a* and 543*b* of the motor cover 540, and the rear cover 560 fixed to an upper jig Z2 is moved to adjust welding positions. Here, the welding portions 562*a* and 562*b* of the rear cover 560 are fitted between the supporting ends 543*a* and 543*b* of the motor cover 540 so that the outer surfaces of the welding portions 562*a* and 562*b* of the rear cover 560 can be brought into contact with the inner surfaces of the supporting ends 543*a* and 543*b* of the motor cover 540. Maintained is an interval between the motor cover 540 and the rear cover 560 set up in consideration of an initial design value, an assembly tolerance and a measurement tolerance.

After the welding positions of the motor cover 540 and the rear cover 560 are adjusted, as shown in FIG. 6, the supporting ends 543*a* and 543*b* of the motor cover 540 and the welding portions 562*a* and 562*b* of the rear cover 560 are firmly surface-welded to each other by using a welding rod W. Here, a plasma welding is carried out.

Accordingly, after the motor cover 540 and the rear cover 560 are welded, when the assembly springs S, the lower jig Z1 and the upper jig Z2 are separated, as shown in FIG. 7, welding beads 580 are generated between the supporting ends 543*a* and 543*b* of the motor cover 540 and the welding portions 562*a* and 562*b* of the rear cover 560 to connect the motor cover 540 to the rear cover 560. Unnecessary parts of the motor cover 540 are cut to form the supporting ends 543*a* and 543*b*, and both ends of the rear cover 560 are bent to form the short welding portions 562*a* and 562*b*. In addition, the supporting ends 543*a* and 543*b* of the motor cover 540 and the welding portions 562*a* and 562*b* of the rear cover 560 are welded to each other by adjusting the welding positions. Consequently, the materials can be less consumed, and the production process can be simplified.

While the present invention has been illustrated and described in connection with the preferred embodiments and the accompanying drawings, the scope of the present invention is not limited thereto and is defined by the appended claims.

The invention claimed is:

1. A linear compressor, comprising:

a fixed member including a cylinder that provides a compression space for refrigerant, an inner stator fixed to an outer circumference of the cylinder and an outer stator fixed between a frame and a motor cover, wherein the frame is integrally formed with the cylinder or separately formed and coupled to the cylinder, and wherein the frame and the motor cover are fastened to each other by a plurality of fastening members; and a moving member including a piston that compresses the refrigerant inside the cylinder, and a supporter connected to a back of the piston in an opposite direction to the compression space, and elastically supported between the motor cover and a rear cover, the moving member being linearly reciprocated with respect to the fixed member, wherein the motor cover is formed in a circular disk shape, including a pair of supporting ends having a rectangular shape and being formed by partially cutting an inner portion of the circular disk-shaped motor cover and bending it backward in the opposite direction to the compression space wherein the rear cover is formed in a shape of a rectangular plate that includes a pair of welding portions bent toward the compression space, the pair of welding portions being a rectangular shape, at both ends of the rear cover, and wherein the pair of welding portions of the rear cover is fitted between the pair of supporting ends of the motor cover and is fixedly welded to the pair of supporting ends of the motor cover.

2. The linear compressor of claim 1, wherein an interior surface of the supporting ends of the motor cover and an exterior surface of the pair of welding portions of the rear cover are surface-welded to each other.

3. The linear compressor of claim 1, wherein an initial position of the piston is set according to axis direction welding positions of the supporting ends of the motor cover and the pair of welding portions of the rear cover where the motor cover and the rear cover are welded to one another.

* * * * *